US006467196B1

(12) United States Patent
Koyama

(10) Patent No.: US 6,467,196 B1
(45) Date of Patent: Oct. 22, 2002

(54) SPIKE ENSURING STABLE KICK DURING RUNNING AND SPIKE SHOES

(76) Inventor: Yoshiki Koyama, 3006-92, Takanoo-cho, Tsu-shi, Mie-ken (JP)

( * ) Notice: Subject to any disclaimer, the term of this patent is extended or adjusted under 35 U.S.C. 154(b) by 0 days.

(21) Appl. No.: 09/774,176

(22) PCT Filed: Aug. 6, 1998

(86) PCT No.: PCT/JP98/03522

§ 371 (c)(1),
(2), (4) Date: Feb. 5, 2001

(87) PCT Pub. No.: WO00/07477

PCT Pub. Date: Feb. 17, 2000

(51) Int. Cl.[7] ..... A43C 15/00; A43B 5/00
(52) U.S. Cl. ..... 36/67 R; 36/67 D; 36/134
(58) Field of Search ..... 36/67 R, 67 D, 36/67 A, 134, 126, 127, 128, 129; D2/962, 951, 954

(56) References Cited

U.S. PATENT DOCUMENTS

| | | | | |
|---|---|---|---|---|
| 2,509,980 | A | * | 5/1950 | McCallum |
| 3,267,593 | A | * | 8/1966 | Turner |
| 3,731,406 | A | * | 5/1973 | Young |
| 3,775,874 | A | * | 12/1973 | Bonneville |
| 3,859,739 | A | * | 1/1975 | Dassler |
| 4,233,759 | A | * | 11/1980 | Bente et al. |
| 4,445,288 | A | * | 5/1984 | Fror |
| 4,769,931 | A | * | 9/1988 | Morrow et al. |
| 5,505,012 | A | * | 4/1996 | Walker et al. |
| 5,655,317 | A | * | 8/1997 | Grant |

FOREIGN PATENT DOCUMENTS

| | | |
|---|---|---|
| JP | 4942451 | 4/1974 |
| JP | 55106103 | 8/1980 |
| JP | 10117812 | 5/1998 |

* cited by examiner

*Primary Examiner*—M. D. Patterson
(74) *Attorney, Agent, or Firm*—Dennison, Schultz & Dougherty

(57) ABSTRACT

The present invention provides a spike, which includes a base (2), a claw (4) formed on a tip end of the base (2) and having a trapezoidal tip end portion, and a recess (6) formed in a rear side of the base (2) and extending from the claw (4) to the base (2), the recess (6) being curved relative to a longitudinal direction (7) of the spike (1). Further, the present invention provides a sport shoe, which includes a spike (11) and a spike fixture (21), the spike (11) including a base (12), a claw (14) formed on a tip end of the base (12) and having a trapezoidal tip end portion, a recess (16) formed in a rear side of the base (12) and extending from the claw (14) to the base (12), the recess (16) being curved relative to a longitudinal direction of the spike (11), and a collar (13) formed on an upper end of the base (12), the collar (13) having indentations (13*a*) formed in the outer peripheral surface thereof, and the spike fixture (21) including a cylindrical portion (22) having indentations (22*b*) that are formed in the inner surface thereof and that engage the indentations (13*a*), the spike fixture (21) being secured to a shoe sole (41), wherein the orientation of the recess (16) can be changed by changing the position of the engagement.

25 Claims, 5 Drawing Sheets

SPIKE ENSURING STABLE KICK DURING RUNNING AND SPIKE SHOES

FIELD OF THE INVENTION

The present invention relates to an improvement in spikes for sport shoes, and more particularly, to an improved spike design that allows a runner to stabilize kicks and to develop maximum propulsion during running without damaging a track.

BACKGROUND OF THE INVENTION

During running in track and field sports, the load on the runner's sole transfers in correspondence with the running movement of the runner. That is, an outer peripheral rear portion of the heel first contacts the ground surface and then the outer peripheral side of the foot arch, the projection of the fifth toe (little toe) and the projection of the first toe (big toe) sequentially contact the ground surface and finally the first to fifth toes contact and kick the ground surface. During the kicking movement, the pressing force of the toe portion of the shoe sole against the ground surface and the repulsive force from the ground surface develop propulsion in order to propel the runner in the forward direction.

During running, in order to enable the runner to exert the most forward propulsion obtained by the kick, it is necessary to prevent the spike disposed within the toe portion of the sport shoes from slipping backward and further to minimize the frictional resistance generated when the spike that pierces the ground surface is pulled out so that the spike can be smoothly pulled out. In other words, it is necessary to strengthen the ground gripping force of the spike and to develop maximum forward repulsion from the ground surface.

FIG. 11 shows seven pin-shaped spikes 95 secured to a front portion 93 of a shoe sole 92 of a shoe 91 of a pair of sport shoes. Designated by numeral 94 is a rear portion of the shoe sole 92.

Further, Japanese Utility Model Publication No. 48-30448 discloses a pin-shaped spike of shoes for track and field sports, which spike includes a semicircular groove formed in the left and right side surfaces of the spike and extends from a base portion to a tip end of the spike along the longitudinal central axis of the spike.

This pin-shaped spike easily pierces the ground during running. Further, by providing the grooves in the right and left side surfaces, the contact area with the ground is increased, and accordingly, the ground gripping force of the right and left side surfaces of the spike is increased. However, when kicking, the ground gripping force of the rear side portion of this pin-shaped spike is insufficient for stable kicks.

Further, in order to obtain stable kicks with this type of pin-shaped spike, the length of the spike must be 9 mm or longer.

However, with such a relatively long spike, the frictional resistance with the ground is increased when the spike, which pierces the ground surface, is pulled out during the kicking movement. Accordingly, the repulsion from the ground surface is significantly reduced and thus forward propulsion is reduced. In addition, if used on an all-weather type paved track, such a spike will damage the paved materials of the track.

It is, accordingly, an object of the present invention to provide a spike which does not have the above-described problems of the prior art and which can stabilize kicks during running movement so as to develop greater propulsion without damaging the track paving materials, and a sport shoe having such spike.

DISCLOSURE OF THE INVENTION

The present invention provides a spike, which includes a base, a claw formed on a tip end of the base and having a trapezoidal tip end portion, and a recess formed in a rear side of the base and extending from the claw to the base, the recess being curved relative to a longitudinal direction of the spike. With this construction, kicks during running movement can be stabilized, and damage to the track can be prevented.

Further, a collar is formed on an upper end of the base, and indentations are formed in the outer peripheral surface of the collar. A spike fixture includes a cylindrical portion having indentations, which indentations are formed on the inner surface of the cylindrical portion and engage the indentations of the collar. The spike fixture is secured to a shoe sole, and the orientation of the recess can be changed by changing the position of the engagement of the indentations. With this construction, maximum propulsion during running can be exerted by changing the orientation of the recess of the spike to correspond to the direction of the particular runner's kick.

BEST MODES FOR CARRYING OUT THE INVENTION

Figure 1:
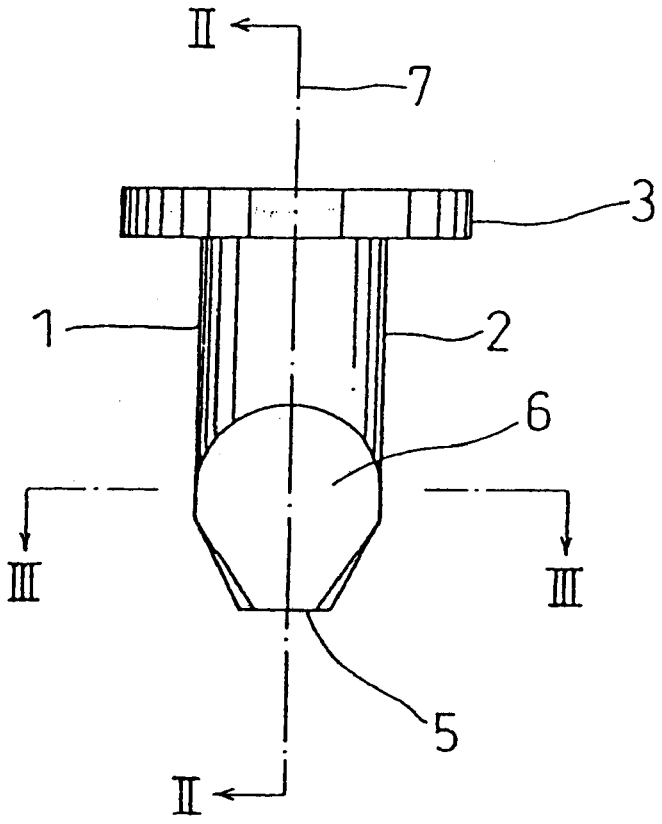
FIG. 1 is a rear view of a spike according to a first embodiment of the invention.
Figure 2:
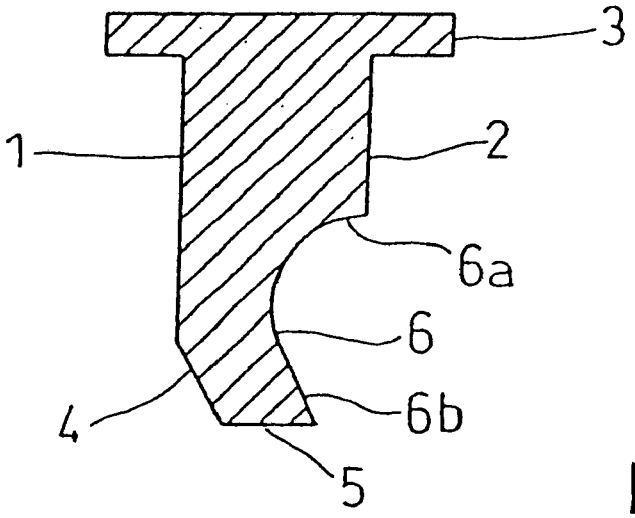
FIG. 2 is a sectional view taken along line II—II of FIG. 1.
Figure 3:
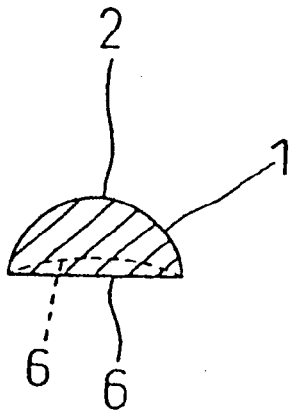
FIG. 3 is a sectional end view taken along line 111—III of FIG. 1.
Figure 4:
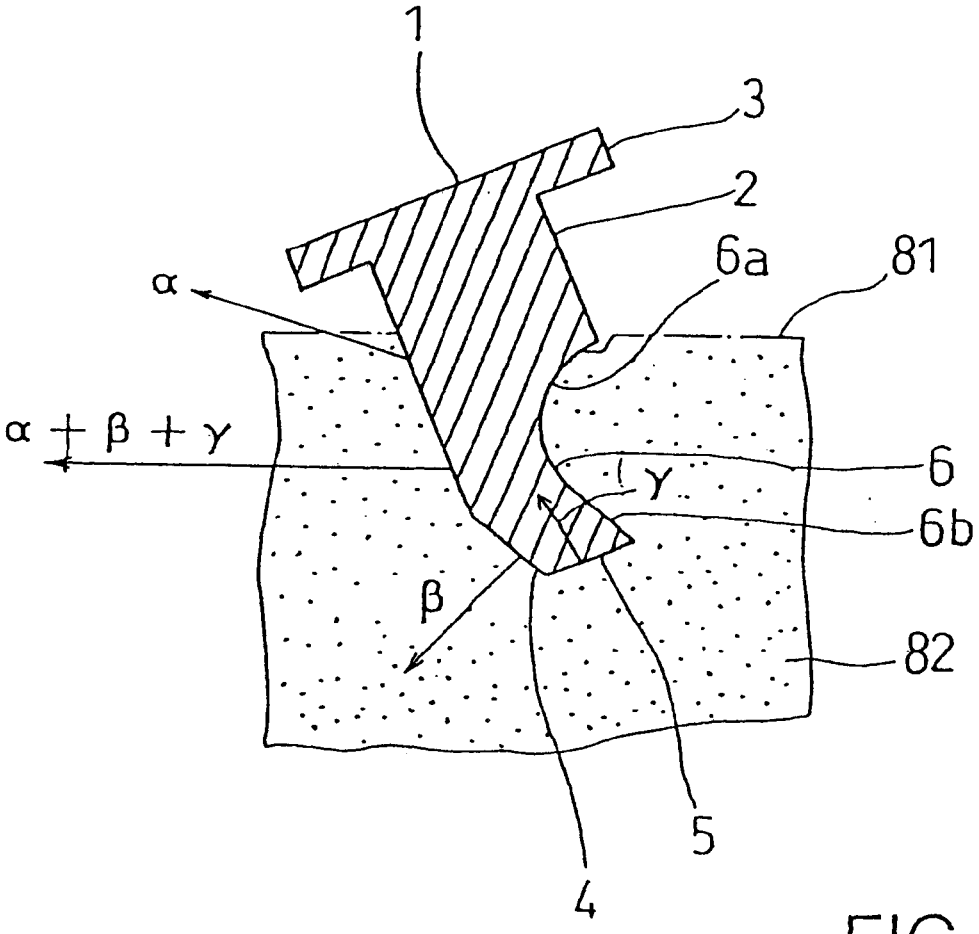
FIG. 4 is a sectional view showing the first embodiment in operation.

The present invention will now be explained in more detail with reference to the accompanying drawings. FIG. 1 is a rear view of a spike according to a first embodiment of the invention; FIG. 2 is a sectional view taken along line II—II of FIG. 1; FIG. 3 is a sectional end view taken along line III—III of FIG. 1; and FIG. 4 is a sectional view showing the first embodiment in operation.

As shown in FIGS. 1 to 4, a spike 1, which in use is attached to a shoe sole of a sport shoe, includes a base 2 and a collar 3 that is integrally formed with the upper end of the base 2. A claw 4 is formed on the tip end (the lower end) of the base 2. A recess 6 is formed in the rear surface of the base 2 to thereby define the claw 4.

Thus, the recess 6 extends from the claw 4 to the base 2 and is curved relative to a longitudinal central axis 7 of the spike 1.

The spike 1 may comprise, for example, hard synthetic resin, aluminum alloy, aluminum alloy subjected to a tufram treatment (formed into a resilient column), stainless steel, carbon steel, cermet, a superalloy such as tungsten, titanium alloy, or an abrasion-resistant material such as a ceramic. The base 2 may be in the form of a cylinder, truncated cone (with the side of the collar 3 as its base), prism, or truncated pyramid (with the side of the collar 3 as its base), or any other appropriate shape. The claw 4 is smaller in diameter than the base 2 and may be formed on the tip end of the base 2 either as an integral or separate part. The claw 4 has a trapezoidal tip end portion with a flat tip end surface 5. The end surface 5 may be of any other shape that can receive a force, which force will be described below and is shown by vector $\gamma$.

The recess 6 may be either spoon-shaped (as shown by a dotted line in FIG. 3) or flat (as shown by a solid line in FIG. 3) in cross-section.

The curved shape of the recess 6 provides the advantage that the spike can be smoothly pulled out of the ground surface by a kick during running.

The spike 1 is fixed to the front portion of the sole (which corresponds to the front portion 93 of the shoe sole 92 shown in FIG. 11), with the recess 6 facing rearward, similar to recess 16 shown in FIG. 10 which will be described below, by means of a fixture (which is similar to fixture 21 which will be described below, except that indentations 22*b* are not necessary for mounting the spike 1). In this state, the base 2 and the claw 4 of the spike 1 project downwardly from the front portion of the shoe sole.

When a runner runs in the sport shoes having the spike 1, the runner's first to fifth toes contact and kick the ground surface 81 backward, and at the same time, the spike 1 digs into the ground 82 through the ground surface 81 under the runner's weight (see FIG. 4).

At this time, because the recess 6 is provided on the rear side of the spike 1, which permits the spike 1 to grip the ground surface 81 in a manner to scoop it with the recess 6, the ground gripping area is increased and the gripping force is significantly strengthened. As a result, even if the length of the spike 1 (along the longitudinal central axis 7) is 8 mm or less, the spike 1 will not slip rearward upon pushing the ground surface 81 in the rearward direction.

Further, upon kicking, the repulsive force from the ground surface 81 is applied to upper portion 6*a*, lower portion 6*b* and the tip end surface 5 of the claw 4 along force vectors $\alpha$, $\beta$, $\gamma$, respectively. Thus, the vector sum $\alpha+\beta+\gamma$ acts forwardly on the spike 1. As a result, the spike 1 can be pulled out of the ground surface 81 without resistance, and the forward propulsion can be significantly increased in the amount of the vector sum a $\alpha+\beta+\gamma$.

Further, because the spike 1 can be as short as 8 mm or less, sport shoes having the spike 1 do not damage paving materials of an all-weather type track.

Figure 5:
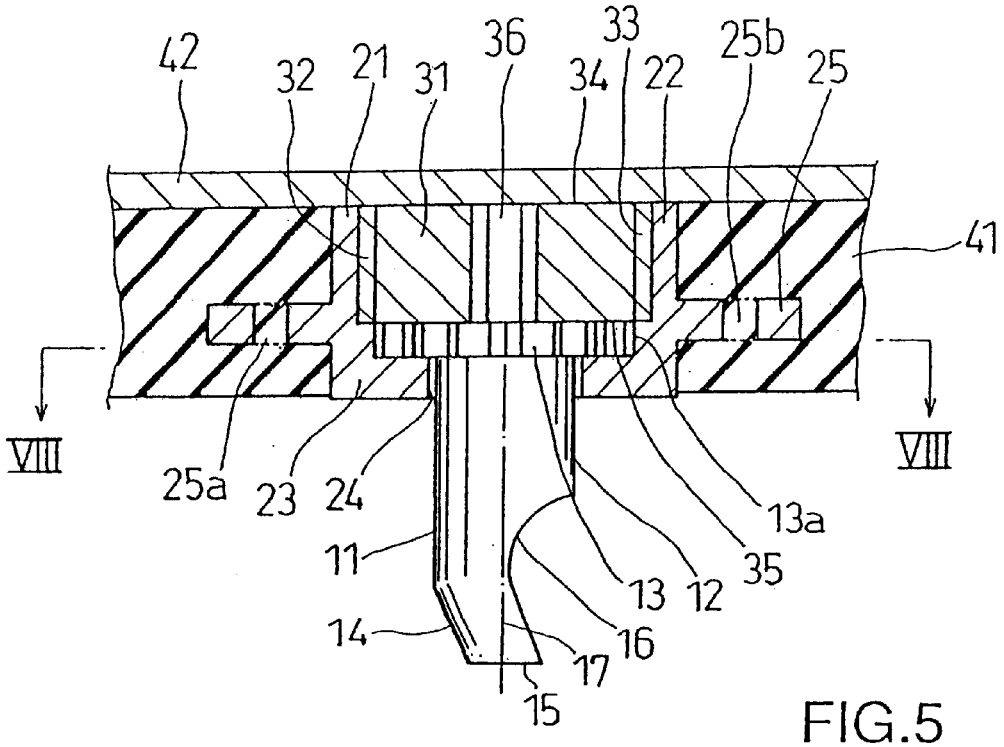
FIG. 5 is a sectional view showing a second embodiment of the invention.
Figure 6:
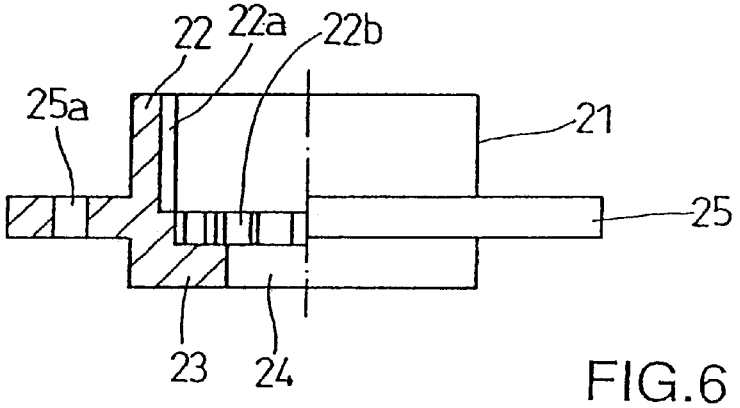
FIG. 6 is a view, half in section, showing a spike fixture for use in the second embodiment.
Figure 7:
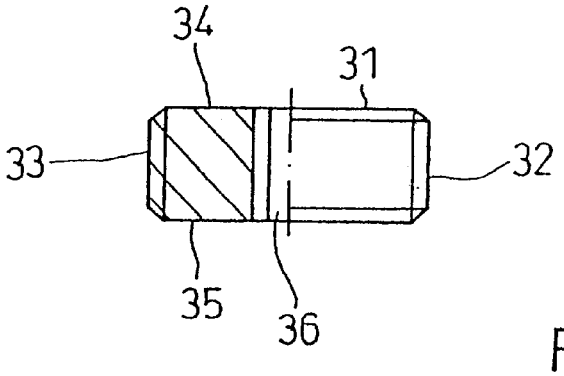
FIG. 7 is a view, half in section, showing a component for use in the second embodiment.
Figure 8:
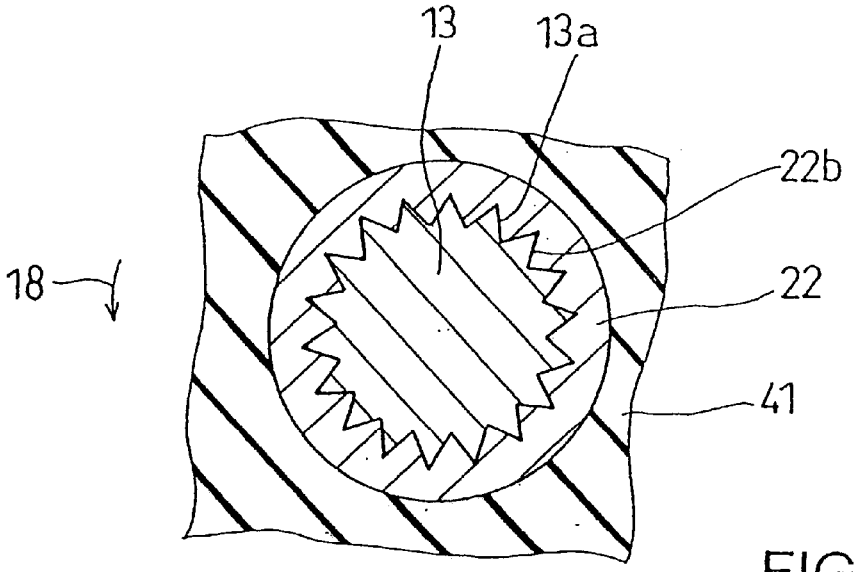
FIG. 8 is a sectional view taken along line VIII—VIII of FIG. 5.

FIGS. 5 to 8 show a second embodiment of the invention. FIG. 5 is a sectional view showing the second embodiment of the invention (in which a spike 11 is shown in side view); FIG. 6 is a view, half in section, showing a spike fixture for use in the second embodiment. FIG. 7 is a view, half in section, showing a cover member for use in the second embodiment; and FIG. 8 is a sectional view taken along line VIII—VIII of FIG. 5.

As shown in FIGS. 5 to 8, a spike 11 includes a base 12, a collar 13 and a claw 14. The base 12 of the spike 11 is, for example, cylindrical, and the collar 13 is integrally formed with the base 12.

Indentations 13*a* are formed in the outer peripheral surface of the collar 13, and a tip end surface 15 (which corresponds to the tip end surface 5) is formed on the tip end of the claw 14. A recess 16 (which corresponds to the recess 6) is formed in the rear surface of the base 12 to thereby define the claw 14. Designated by numeral 17 is a longitudinal central axis of the spike 11.

A fixture 21 may comprise hard synthetic resin, metal, ceramics or similar materials, and a hole 24 is formed through a bottom plate 23 of a cylindrical portion 22 of the fixture 21. A female thread portion 22*a* and indentations 22*b* are formed in the inner surface of the cylindrical portion 22, and a flange portion 25 is formed on the outer surface of the cylindrical portion 22. Holes 25*a*, 25*b* are formed through the flange portion 25.

A cover member 31 is generally disc-shaped, a male thread portion 33 is formed on the outer peripheral surface 32 of the cover member 31, and a hole 36 extends through the cover member 31 from one side 34 to the other side 35. The cover member 31 can be rotated by inserting a hexagonal wrench into the hole 36.

The fixture 21 is embedded in a shoe sole 41. An insole 42 is adhered to the inner surface of the shoe sole 41.

As shown in FIG. 8, the indentations 13*a* of the collar 13 of the spike 11 engage the indentations 22*b* of the cylindrical portion 22. The state (position) of the engagement between the indentations 13*a* and 22*b* can be changed by detaching the collar 13 from the cylindrical portion 22 of the fixture 21 and then rotating the collar 13 in a direction shown by arrow 18 or in the opposite direction. In this manner, the orientation of the spike 11 attached to the fixture 21 can be changed as shown in FIG. 10, which will be described below.

Figure 9:
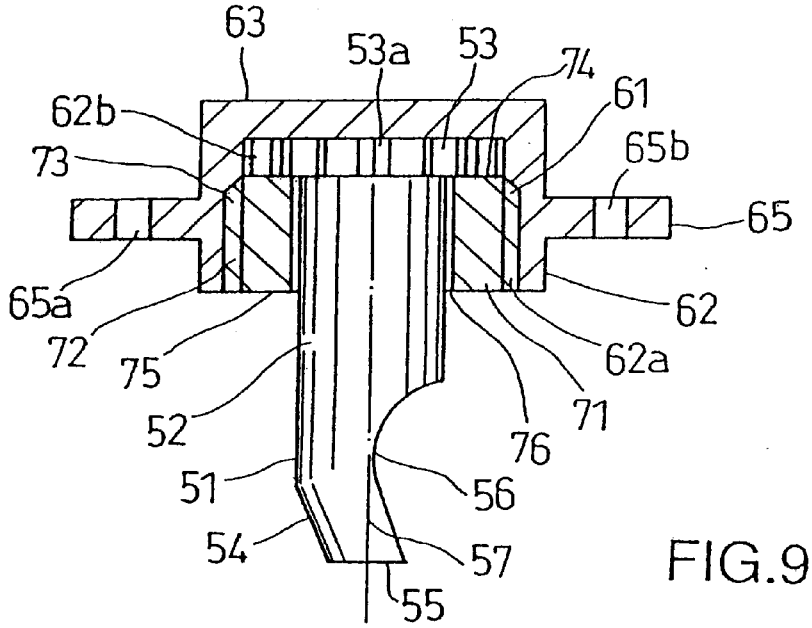
FIG. 9 is a sectional view showing a modification of the second embodiment.

FIG. 9 shows a modification of the second embodiment. A spike 51 has a base 52 (in the form, for example, of a cylinder) and a collar 53 that is integrally formed with the base 52. Indentations 53*a* are formed in the outer peripheral surface of the collar 53. A claw 54 is formed on the tip end of the base 52 and a tip end surface 55 (which corresponds to tip end surface 5) is formed on the tip end of the claw 54. A recess 56 (which corresponds to recess 6) is formed in the rear surface of the base 52 to thereby define the claw 54. Designated by numeral 57 is a longitudinal central axis of the spike 51.

A fixture 61 has a cylindrical portion 62 and a bottom plate 63 formed on an end of the cylindrical portion 62. A female thread portion 62*a* and indentations 62*b* are formed in the inner surface of the cylindrical portion 62. A flange portion 65 (which corresponds to the flange portion 25) is formed on the outer surface of the cylindrical portion 62, and holes 65*a*, 65*b* are formed through the flange portion 65. Further, the fixture 61 has a ring 71. A male thread portion 73 is formed on the outer periphery 72 of the ring 71, and a hole 76 extends through the ring 71 from one side 74 to the other side 75.

The ring 71 can be rotated by inserting a metal stick or similar tool into a recess (or a hole or a groove) formed in the other side 75 of the ring 71, which recess is not shown. At this time, the female thread portion 73 threadably engages the male thread portion 62*a* to thereby tighten or loosen the ring 71.

Similar to the engagement between the indentations 13*a* of the collar 13 of the spike 11 and the indentations 22*b* of the cylindrical portion 22 of the fixture 21, the indentations 53*a* of the collar 53 of the spike 51 engage the indentations 62*b* of the fixture 61. Similar to fixture 21, fixture 61 is embedded in a shoe sole.

In the second embodiment, the spike 11 is inserted through the cylindrical portion 22 of the fixture 21 such that the base 12 and the claw 14 of the spike 11 project outwardly through the hole 24 of the bottom plate 23. Thus, in the same manner as shown in FIG. 4, the base 12 and the claw 14 of the spike 11 dig into the ground surface (contact surface) 81 when running.

The spike 11 can be pressed and secured by threading engagement between the male thread portion 33 of the cover member 31 and the female thread portion 22*a* of the cylindrical portion 22. Thus, the spike 11 can be prevented from becoming loosened by external impact. Similarly, in the modification shown in FIG. 9, the ring 71 and the cylindrical portion 62 serve to prevent the spike 51 from becoming loosened by external impact.

Generally, slight differences exist among individuals in the direction of kicking the ground surface 81 that their shoes contact, that is, in the backward facing angle (the angle between the backward direction when running and the kicking direction).

However, the orientation of the recesses 16, 56 with respect to the direction toward the shoe heel can be adjusted by rotating the spikes 11, 51 around the an longitudinal central axis 17, 57 in a direction shown by arrow 18 in FIG. 8 or in the opposite direction, when mounting the spikes 11, 51 to the fixtures 21, 61 embedded in the front portion of the shoe sole.

Figure 10:
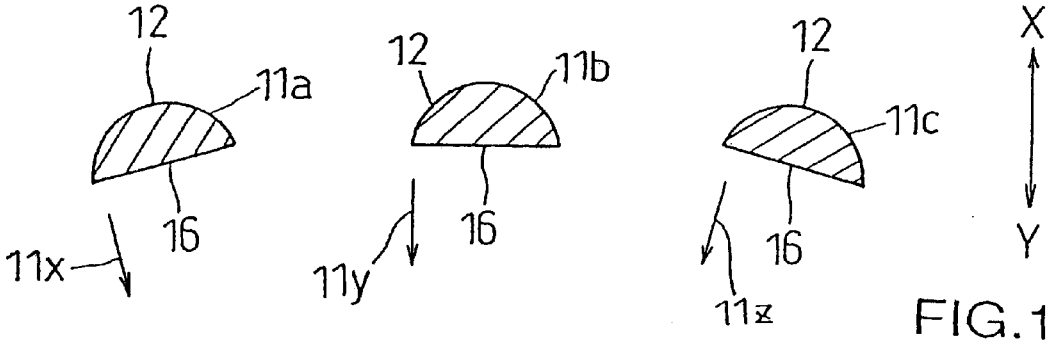
FIG. 10 is a explanatory view showing the second embodiment in operation.
Figure 11:
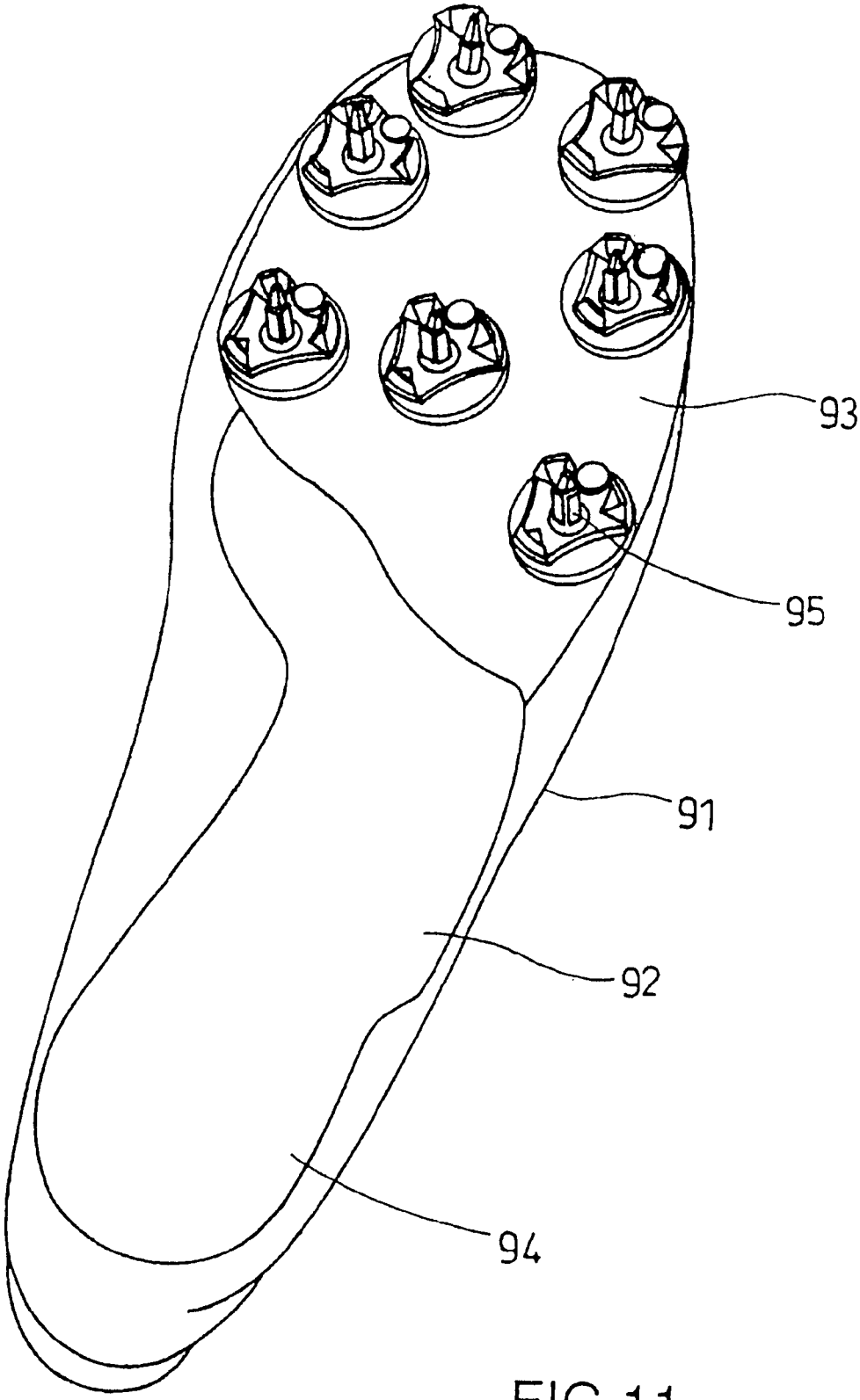
FIG.11 PRIOR ART
FIG. 11 is a perspective view of the prior art.

FIG. 10 shows positions of the spike 11 mounted to a left shoe after such adjustment. Each figure within FIG. 10 corresponds to FIG. 3.

The recess 16 of the spike 11 in position 11a land position 11*c* is oriented inwardly (in the direction shown by arrow 11*x*) and outwardly (in the direction shown by arrow 11*z*), respectively, with respect to a longitudinal center line X-Y (X is the forward direction and Y is the rearward direction) that connects a center point of the toe portion and a center point of the heel portion of the shoe sole. The recess 16 of the spike 11 in position 11*b* is oriented in the direction parallel to the center line X-Y (in the direction shown by arrow 11*y*).

The cylindrical portions 22, 62 may have any other hollow shape, provided that the orientation of the recesses 16, 56 of the spikes 11, 51 can be adjusted as shown in FIG. 10.

As described above, the orientation of the recesses 16, 56 can be adjusted to correspond to the direction of kicking of the particular runner that is wearing the shoes by adjusting the position of engagement between the indentations 13*a*, 53*a* of the collars 13, 53 of the spikes 11, 51 and the indentations 22*b*, 62*b* of the cylindrical portions 22, 62. As a result, the maximum propulsion during running movement can be exerted in accordance with the particular runners' kicking style, so that running speed can be increased.

INDUSTRIAL UTILITY

Spikes and the sport shoes having the spikes according to the present invention serve to increase running speed in track or other sports and also serve to reduce track maintenance requirements.

What is claimed is:

1. A spike comprising:

a base having a cylindrical configuration;

a claw extending from the base, the claw having a frustoconical configuration and a single recess extending across the claw and a portion of the base and being curved relative to a longitudinal direction of the spike.

2. A spike as defined in claim 1, further comprising a collar that is integrally formed at the upper end of the base.

3. A spike as defined in claim 2, wherein the collar comprises indentations formed on the outer peripheral surface thereof.

4. A spike as defined in claim 3, wherein the diameter of the claw is smaller than the diameter of the base.

5. A spike as defined in claim 3, wherein the claw comprises a flat tip end surface.

6. A spike as defined in claim 5, wherein the recess is concave.

7. A spike as defined in claim 6, wherein the spike has a length less than 8 mm.

8. A spike as defined in claim 1, wherein the diameter of the claw is smaller than the diameter of the base.

9. A spike as defined in claim 1, wherein the claw comprises a flat tip end surface.

10. A spike as defined in claim 1, wherein the recess is concave.

11. A spike as defined in claim 1, wherein the spike has a length less than 8 mm.

12. A sport shoe comprising:

a spike fixture embedded with the sports shoe and a spike as defined in claim 3 rotatably mounted within the spike fixture, wherein the spike fixture comprises means for adjusting the orientation of the recess by rotating the spike around the longitudinal axis of the spike in order to correspond to the direction of kicking of a particular runner and means for locking the orientation of recess.

13. A sport shoe comprising:

a spike fixture embedded within the sports shoe and a spike as defined in claim 3, wherein the collar is rotatably mounted within the spike fixture and the base extends through a hole defined within the spike fixture, wherein the spike fixture comprises means for adjusting the orientation of the recess by rotating the spike around the longitudinal axis of the spike in order to correspond to the direction of kicking of a particular runner and means for locking the orientation of recess.

14. A sport shoe comprising:

a spike fixture embedded within the sports shoe and a spike as defined in claim 6, wherein the collar is rotatably mounted within the spike fixture and the base extends through a hole defined within the spike fixture, wherein the spike fixture comprises means for adjusting the orientation of the recess by rotating the spike around the longitudinal axis in order to correspond to the direction of kicking of a particular runner and means for locking the orientation of recess.

15. A sport shoe as defined in claim 14, wherein the spike is less than 8 mm.

16. A sport shoe comprising:

a spike as defined in claim 3 and a spike fixture secured to a shoe sole, the spike fixture comprising a plate having a hole defined therein, wherein the base extends through the hole and the diameter of the collar is larger than the diameter of the hole, such that the collar is disposed on one side of the plate and the claw is disposed on the other side of the plate, wherein the spike fixture further comprises a cylindrical portion having indentations formed on the inner surface thereof, wherein the collar indentations are engaged with spike fixture indentations and the orientation of the recess is changeable by changing the position of said engagement.

17. A sport shoe as defined in claim 16, further comprising a ring having a male thread portion, wherein the spike fixture has a female thread portion engaged with the male thread portion.

18. A sport shoe comprising:

a spike as defined in claim 6 and a spike fixture secured to a shoe sole, the spike fixture comprising a plate having a hole defined therein, wherein the base extends through the hole and the diameter of the collar is larger than the diameter of the hole, such that the collar is disposed on one side of the plate and the claw is disposed on the other side of the plate, wherein the spike fixture further comprises a cylindrical portion having indentations formed on the inner surface thereof, wherein the collar indentations are engaged with spike fixture indentations and the orientation of the recess is changeable by changing the position of said engagement.

19. A sport shoe as defined in claim 18, further comprising a ring having male thread portion, wherein the spike fixture has a female thread portion engaged with the male thread portion.

20. A sport shoe as defined in claim 18, wherein the spike is less than 8 mm.

21. An apparatus comprising:

a spike comprising a collar, a base extending from the collar, a claw extending from the base and having a frustoconical configuration, and a recess extending across the claw and at least a portion of the base, the recess being curved relative to a longitudinal direction of the spike, and a spike fixture rotatably retaining the collar, the spike fixture comprising a plate having a hole defined therein, wherein the base extends through the hole and the diameter of the hole is less than the outer diameter of the collar, such that the collar is disposed on one side of the plate and the claw is disposed on the other side of the plate.

22. An apparatus as in claim 21, wherein the spike fixture comprises means for rotatably adjusting the orientation of the recess while the collar is disposed within the spike fixture and means for locking the orientation of the recess.

23. An apparatus as in claim 22, wherein the collar further comprises a plurality of indentations disposed around an outer peripheral edge of the collar and the locking means comprises a plurality of corresponding indentations disposed around an inner peripheral edge of the spike fixture, wherein the locked orientation of the recess can be changed by changing the position of the engagement of the respective indentations.

24. An apparatus as in claim 23, wherein the base is cylindrical and the spike has only a single recess that does not extend over the length of the entire base.

25. An apparatus as in claim 24, further comprising a shoe having a shoe sole, wherein the spike fixture is fixedly disposed within the shoe sole.

* * * * *